US010582735B2

(12) United States Patent
Regan

(10) Patent No.: US 10,582,735 B2
(45) Date of Patent: Mar. 10, 2020

(54) ARTICLE CONFIGURED FOR REMOVABLE ATTACHMENT OF AN ADORNMENT

(71) Applicant: Select Patch, Inc., North Andover, MA (US)

(72) Inventor: Dennis R. Regan, North Andover, MA (US)

(73) Assignee: SELECT PATCH, INC., North Andover, MA (US)

( * ) Notice: Subject to any disclaimer, the term of this patent is extended or adjusted under 35 U.S.C. 154(b) by 250 days.

(21) Appl. No.: 15/674,005

(22) Filed: Aug. 10, 2017

(65) Prior Publication Data

US 2018/0042325 A1 Feb. 15, 2018

Related U.S. Application Data

(60) Provisional application No. 62/374,196, filed on Aug. 12, 2016, provisional application No. 62/430,421, filed on Dec. 6, 2016.

(51) Int. Cl.
*A42B 1/24* (2006.01)
*A45F 3/04* (2006.01)
(Continued)

(52) U.S. Cl.
CPC ..... *A42B 1/248* (2013.01); *A41D 27/08* (2013.01); *A42B 1/062* (2013.01); *A45F 3/04* (2013.01);
(Continued)

(58) Field of Classification Search
CPC .. A41D 27/08; A41D 2300/326; A42B 1/062; A42B 1/248; A45C 13/08; A45F 2003/001; A45F 3/04
See application file for complete search history.

(56) References Cited

U.S. PATENT DOCUMENTS 2,803,829 A * 8/1957 Tscharner ..... A42B 1/004 40/329
4,333,180 A 6/1982 Bay
(Continued)

FOREIGN PATENT DOCUMENTS

WO 2008032097 A1 3/2008

OTHER PUBLICATIONS

Generic Special Force Tactical CAP Hat w/US Flag Patch MultiCap, [on-line]; [review posted to the Internet Jun. 13, 2011]; [retrieved from the Internet Nov. 14, 2016]; URL: < https://www.amazon.com/Generic-Special-Force-Tactical-MultiCam/dp/8001 QW5FOA>. (4 pages).
(Continued)

*Primary Examiner* — Yan Lan
(74) *Attorney, Agent, or Firm* — Burns & Levinson, LLP; Daniel J. McGrath

(57) ABSTRACT

Disclosed is an article that allows for removable attachment of an adornment. The article has an inner layer of material and an outer layer of material. The outer layer of material is adjacent to an exterior surface of the inner layer of material, the outer layer forming an aperture around a first portion of the exterior surface of the inner layer. A coupling mechanism attaches the outer layer to the inner layer at an attachment location surrounding the aperture. A cavity adjacent to the aperture and between the inner layer and the outer layer receives the adornment for removable attachment of the adornment to the article.

12 Claims, 6 Drawing Sheets

(51) Int. Cl.

| | |
|---|---|
| ***A45C 13/08*** | (2006.01) |
| ***A41D 27/08*** | (2006.01) |
| ***A42B 1/06*** | (2006.01) |
| ***A45F 5/02*** | (2006.01) |
| *A45F 3/00* | (2006.01) |

(52) U.S. Cl.

CPC ..... *A45F 5/02* (2013.01); *A41D 2300/326* (2013.01); *A45C 13/08* (2013.01); *A45F 2003/001* (2013.01)

(56) References Cited

U.S. PATENT DOCUMENTS

| | | | | |
|---|---|---|---|---|
| 4,776,043 | A | 10/1988 | Coleman | |
| 4,873,726 | A | 10/1989 | Tapia | |
| 4,918,758 | A | 4/1990 | Rendina | |
| 4,985,935 | A | 1/1991 | Hur | |
| 5,003,640 | A | 4/1991 | Pizzacar | |
| 5,070,545 | A | 12/1991 | Tapia | |
| 5,253,368 | A | 10/1993 | Blake | |
| 5,276,985 | A | 1/1994 | Halloran | |
| 5,282,278 | A | 2/1994 | Miner | |
| 5,359,733 | A | 11/1994 | Brannon et al. | |
| 5,359,734 | A | 11/1994 | Rathbum | |
| 5,369,899 | A | 12/1994 | Reeves | |
| 5,373,586 | A | 12/1994 | Brosnan | |
| 5,452,479 | A | 9/1995 | Mostert | |
| 5,509,144 | A | 4/1996 | Soergel et al. | |
| 5,581,813 | A | 12/1996 | Henschel | |
| 5,740,557 | A | 4/1998 | Reid et al. | |
| 5,803,266 | A | 9/1998 | Blackwelder | |
| 5,845,334 | A | 12/1998 | Marcolini | |
| 5,862,523 | A | 1/1999 | Proctor | |
| 5,901,381 | A | 5/1999 | Nelson | |
| 6,175,963 | B1 | 1/2001 | Loeffelholz | |
| 6,311,332 | B1 | 11/2001 | Lien | |
| 6,339,866 | B1 | 1/2002 | French | |
| 6,367,088 | B1 | 4/2002 | Bergemann | |
| 6,442,972 | B1 | 9/2002 | Watson | |
| 6,447,628 | B1 | 9/2002 | Couillard et al. | |
| 6,513,221 | B2 | 2/2003 | Vogt et al. | |
| 6,519,778 | B2 | 2/2003 | Arias et al. | |
| 6,519,779 | B1 * | 2/2003 | Taguchi | A42B 1/248 2/195.1 |
| 6,539,553 | B2 | 4/2003 | Day | |
| D474,000 | S | 5/2003 | O'Dell et al. | |
| 6,643,847 | B1 | 11/2003 | Dornak | |
| 6,652,696 | B2 | 11/2003 | Kuen et al. | |
| 6,729,058 | B2 | 5/2004 | Ferguson | |
| 6,761,711 | B1 | 7/2004 | Fletcher et al. | |
| D510,471 | S | 10/2005 | Yan | |
| 7,137,149 | B2 | 11/2006 | Kronenberger | |
| 7,243,377 | B2 | 7/2007 | Ashy | |
| D549,931 | S | 9/2007 | Melton | |
| D619,336 | S | 7/2010 | Eyl | |
| D628,774 | S | 12/2010 | Sykes et al. | |
| 8,121,335 | B2 | 2/2012 | Sharpe et al. | |
| 8,474,064 | B2 | 7/2013 | Hardy, III | |
| 8,869,312 | B2 | 10/2014 | Tuohy et al. | |
| D764,151 | S | 8/2016 | Gewirz et al. | |
| 2001/0034894 | A1 | 11/2001 | Godfrey et al. | |
| 2005/0229290 | A1 | 10/2005 | Brooks | |
| 2010/0299979 | A1 | 12/2010 | Lamere | |
| 2010/0313334 | A1 | 12/2010 | Moy | |
| 2012/0005809 | A1 | 1/2012 | Johnson | |
| 2012/0271212 | A1 | 10/2012 | Grisham-Algots | |
| 2012/0291179 | A1 | 10/2012 | Shea | |
| 2014/0096300 | A1 | 4/2014 | Ross et al. | |
| 2014/0208483 | A1 | 7/2014 | Tuohy et al. | |
| 2014/0304890 | A1 | 10/2014 | Carra | |
| 2015/0327614 | A1 | 11/2015 | Garden, Sr. | |

OTHER PUBLICATIONS

Navy Blue Two-Patch . . . Cap, [on-line]; [unknown Internet publication date]; [retrieved from the Internet Nov. 14, 2016]; URL: < http://www.selectpatch.com/Select_Patch/(New_Color)-Navy_Blue_TwoPatch_(Left_Side_While_Wearing_and_Right_Side_While_Wearing)_Unstructured_Cap/Sku-2A1k30/1001061-1001656>. (1 page).

White US Flag . . . Cap, [on-line]; [unknown Internet publication date]; [retrieved from the Internet Nov. 14, 2016]; URL: http://www.selectpatch.com/Select_Patch/(New_Color)-White_U.S_Flag_embroidered_OnePatch_(Left_Side_While_Wearing)_Unstructured_Cap/SKU-2A1B1001/1001073-1001668>. (1 page).

Clothesline, "Patch Hats; Next Big Thing for Kids," http://blogs.longislandpress.com/clothesline/2012/05/patch-hats-next-big-thing-for-kids/, posted on May 4, 2012 (2 pages).

amazon.com, "RAPDOM Tactical Constructed Ball Operator Cap Black Caps with Free Patch," http://www.amazon.com/RAPDOM-Tactical-Constructed-Operator-BJack/dp/B008L3KKBW, posted at least as early as Mar. 31, 2015 (1 page).

amazon.com "Tactical Operator Field Hook and Loop Patch Pad Adjustable/Velcro Baseball Cap/Hat, Color: Olive . . . ," http://www.amazon.com/Tactical-Operator-Adjustable-Velcro-Baseball/dp/B00MX18H1G, posted at least as early as Mar. 31, 2015 (1 page).

ecapcity.com, partial screen shot of "Home//Hats//Side Patched New Era Hats," http://www.ecapcity.com/new-era-fittedbhats/side-patched-new-era-fitted-hats-world-series-allstar-championship-anniversary.html, posted at least as early as Mar. 31, 2015 (1 page).

patchhats.com, "A New Pal with Every Patch," https://web.archive.org/web/20120512220257/http://www.patchhats.com, posted at least as early as Sep. 15, 2015 (2 pages).

prnewswire.com, "Wearable, Collectable, Tradable Patch Hats Launches First-of-Its-Kind Kids' Customizable Accessories Line," http://www.prnewswire.com/news-releases/wearable-collectable-tradable-patch-hats-launches-first-of-its-kind-kids-customizable-accessories-line-146973595.html posted at least as early as Sep. 15, 2015 (3 pages).

gadsdenandculpeper.com, "Build Your Tactical Hat w/Patches," http://www.gadsdenandculpeper.co/custom-tactical-cap.html, posted at least as early as Sep. 15, 2015 (5 pages).

* cited by examiner

ARTICLE CONFIGURED FOR REMOVABLE ATTACHMENT OF AN ADORNMENT

CROSS REFERENCE TO RELATED APPLICATIONS

This application claims priority to and the benefit of U.S. Provisional Patent Application No. 62/374,196, filed on Aug. 12, 2016 and titled "PATCH RECEPTACLE FOR REMOVABLE PATCHES" and U.S. Provisional Patent Application No. 62/430,421, filed on Dec. 6, 2016 and titled "PATCH RECEPTACLE FOR REMOVABLE PATCHES" the contents of both of which are incorporated herein by reference as though fully set forth herein.

FIELD

The present teachings relate to articles of clothing, accessories, and the like, and more particularly to articles configured for removable attachment of adornments.

BACKGROUND

For various apparel articles such as jackets, baseball caps, and other products, as well as accessory articles such as backpacks and cinch bags, it may be desirable to have adornments, such as a patch, attached thereto. In certain applications use of a removable adornment (e.g. a removable patch) is advantageous as the indicia on the apparel or accessory can be changed by the user by simply replacing the adornment.

A removable adornment can be attached to apparel and other products and accessories (articles) via numerous fastening techniques. For example, a patch can be removably attached to an article of manufacture using Velcro® (a hook-and-loop fastener or attachment system), magnets, adhesives, snaps, buttons, and pins. However, such attachment techniques often result in the patch protruding away from the surface of the apparel or product, which can look low-cost, unprofessional, and/or permit the patch to be unintentionally or accidently removed. In addition, the entire surface of the patch including its borders may not be flush with the surface of the apparel or accessory thereby causing wrinkles or other unevenness of the patch and its borders, again resulting in a low-cost, unsophisticated look.

In certain designs, the patch can have a border such as a stitched border around the patch. The stitched border can be a merrowed border or a satin stitched border. Although such borders on a patch can improve the look of the patch on the apparel or accessory, similar issues can be present for removable patches with borders as with removable patches without borders (e.g., patches having hot cut borders).

Thus, there is a need to improve the removable attachment of adornments to apparel and other products and accessories, which attachment can include patch receptacles for removable patches, such that imperfections of the adornment cannot be readily seen and/or the resulting combination of the adornment and the article can present the look of a bordered adornment on the apparel or accessory, despite the adornment being borderless.

SUMMARY

In light of the foregoing, the present invention provides articles configured for removable attachment of adornments that address various deficiencies and/or shortcomings of the state-of-the-art, including those outlined above. For example, the present invention may be an article having two layers of material which form a cavity that is capable of receiving (or adapted or configured to receive) the outer edges of an adornment, when the adornment is present therein. The present invention also provides a patch receptacle that holds or secures a patch therein which can be affixed to the article.

In one aspect, the present invention relates to an article allowing for removable attachment of an adornment. The article has an inner layer of material and an outer layer of material adjacent to an exterior surface of the inner layer of material. The outer layer forms an aperture around a first portion of the exterior surface of the inner layer. A coupling mechanism attaches the outer layer to the inner layer at an attachment location surrounding the aperture. A cavity adjacent to the aperture and between the inner layer and the outer layer receives the adornment for removable attachment of the adornment to the article.

In some embodiments, the article includes a fastening mechanism coupled to the first portion of the exterior surface of the inner layer for further removably securing the adornment when the adornment is attached to the article. The fastening mechanism and the adornment can be configured for removable attachment to one another via a hooks and loop mechanism. The coupling mechanism can be stitching, the stitching partially protruding from an exterior surface of the outer layer. The outer layer can include a material-raising structure surrounding the aperture. The material-raising structure can protrude outwardly from a flat portion of an exterior surface of the outer layer and secure the adornment when the adornment is attached to the article. In various embodiments, the article is designed to have a stitched border (e.g., a raised stitched border) so that a borderless adornment can appear to have a border and be part of the article while still being removable, transferable, and/or replaceable and maintaining a sophisticated bordered look. Indeed, the articles of the present invention permit small sizing and/or shape imperfections in the manufacture of the article and/or adornment but permit the assembled article-adornment to present the look of a bordered adornment.

A related aspect of the present invention is directed to an article allowing for removable attachment of an adornment having an inner layer and outer layer. The outer layer is adjacent to an exterior surface of the inner layer. An inner edge of the outer layer defines an aperture surrounding a first portion of the exterior surface of the inner layer. A coupling mechanism attaches the outer layer to the inner layer at an attachment location surrounding the inner edge of the outer layer such that an inner lip of the outer layer is formed between the attachment location and the inner edge. A cavity between the inner layer and the inner lip of the outer layer is configured to receive outer edges of the adornment to removably attach the adornment to the article. When the adornment is attached to the article, an exterior surface of the adornment is exposed via the aperture.

In some embodiments, the article includes a fastening mechanism coupled to the first portion of the exterior surface of the inner layer for further removably securing the adornment when the adornment is attached to the article. The fastening mechanism can have a plurality of hooks and the adornment can have a plurality of loops on an interior surface, the loops configured to couple to the hooks for removably attaching the adornment to the fastening mechanism. Alternatively, the fastening mechanism can have a plurality of loops and the adornment can have a plurality of hooks on an interior surface, the loops configured to couple to the hooks for removably attaching the adornment to the fastening mechanism.

In some other embodiments, the article includes a back lining disposed adjacent to an interior surface of the inner layer proximate to the first portion. The back lining can couple to the outer layer at a location surrounding the attachment location. In some cases, a material-raising structure is secured to an exterior surface of the inner lip. The material-raising structure can extend: outwardly from an exterior surface of the inner lip; and at least partially over the aperture to further secure the adornment when the adornment is attached to the article. A fastening mechanism can couple to the first portion of the exterior surface of the inner layer for further removably securing the adornment when the adornment is attached to the article. The fastening mechanism and the adornment can be configured for removable attachment via hooks and loops. In some cases, the aperture is circular and the adornment is a circular patch. The attachment location can sometimes form a circular perimeter at a distance from the aperture. The cavity can also be further located between the attachment location and the aperture. In some embodiments the article includes a back lining coupled to the outer layer at a location surrounding the attachment location, the back lining covering an interior surface of the inner layer. The article can be configured to be worn as a hat or carried and hold items as a bag.

Another aspect of the present invention is directed to a patch receptacle for attaching a removable patch to an article. The patch receptacle includes an outer layer of material, wherein an inner edge of the outer layer of material surrounds an aperture. An inner layer of material adjacent to the outer layer of material has: a surface area greater than a surface area of the aperture and covering the aperture; and an attachment mechanism positioned to coincide with the aperture. When the inner layer is secured to the outer layer at a location surrounding the inner edge of the outer layer a cavity between the outer layer and the inner layer for securing the removable patch within the article is formed.

In some embodiments, the patch receptacle is a pocket attached to the article via stitching.

The foregoing, as well as other features and advantages of the present teachings, will be more fully understood from the following figures, description, examples, and claims.

DESCRIPTION OF DRAWINGS

It should be understood that the drawings described below are for illustration purposes only. Like numerals generally refer to like parts. The drawings are not necessarily to scale, with emphasis generally being placed upon illustrating the principles of the present teachings. The drawings are not intended to limit the scope of the present teachings in any way.

FIGS. 1A and 1B are side cross-sectional views of an article and corresponding adornment in accordance with the subject disclosure, wherein FIG. 1A depicts the article without the adornment attached and FIG. 1B depicts the article with the adornment attached thereto.

FIGS. 2A and 2B are perspective views of an article and corresponding adornment in accordance with the subject disclosure, wherein FIG. 2A depicts the the article with the adornment attached thereto.

FIGS. 3A and 3B are cross-sectional views of another embodiment of an article and corresponding adornment in accordance with the subject technology, wherein FIG. 3A depicts the article without the adornment attached thereto and FIG. 3B depicts the article with the adornment attached thereto.

FIGS. 4A and 4B are perspective views of a baseball cap configured for removable attachment of adornments in accordance with the subject disclosure, wherein FIG. 4A depicts the baseball cap and the adornments separately and FIG. 4B depicts the adornments attached to the baseball cap.

DETAILED DESCRIPTION

Figure 1A:
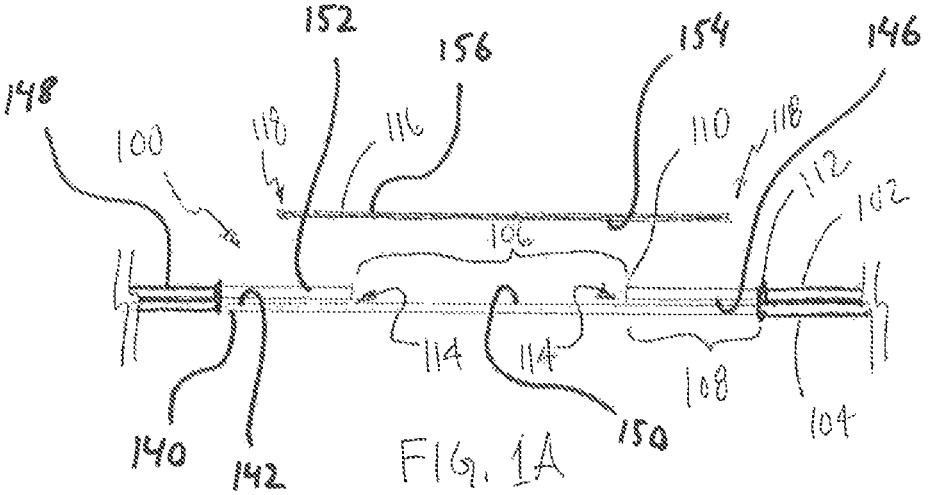

The present invention is based on a discovery that adornments can be removably attached to articles in a way that can conceal the edges of the adornment (e.g., a borderless patch), present a bordered adornment, and/or hold or secure the adornment to the article, without a separate attachment mechanism or system. That is, the design and construction of an article of the present teachings creates a cavity between an outer layer and an inner layer of the article such that the cavity can conceal and contain the edges of the adornment for aesthetic purposes and/or can physically hold or secure the adornment to the apparel or product. Accordingly, the present invention provides articles for removably attaching adornments and methods for creating and using the same. In some cases, the article may also be a portion of a larger end article, such as a receptacle which is affixed to the material of a baseball cap such that an adornment, such as a patch, can be removably attached.

Throughout the application, where compositions are described as having, including, or comprising specific components, or where processes are described as having, including, or comprising specific process steps, it is contemplated that compositions of the present teachings also consist essentially of, or consist of, the recited components, and that the processes of the present teachings also consist essentially of, or consist of, the recited process steps.

In the application, where an element or component is said to be included in and/or selected from a list of recited elements or components, it should be understood that the element or component can be any one of the recited elements or components, or the element or component can be selected from a group consisting of two or more of the recited elements or components.

Further, it should be understood that elements and/or features of a composition, an apparatus, or a method described herein can be combined in a variety of ways without departing from the spirit and scope of the present teachings, whether explicit or implicit herein. For example, where reference is made to a particular structure, that structure can be used in various embodiments of apparatus of the present teachings and/or in methods of the present teachings, unless otherwise understood from the context. In other words, within this application, embodiments have been described and depicted in a way that enables a clear and concise application to be written and drawn, but it is intended and will be appreciated that embodiments may be variously combined or separated without parting from the present teachings and invention(s). For example, it will be appreciated that all features described and depicted herein can be applicable to all aspects of the invention(s) described and depicted herein.

It should be understood that the expression "at least one of" includes individually each of the recited objects after the expression and the various combinations of two or more of the recited objects unless otherwise understood from the context and use. The expression "and/or" in connection with three or more recited objects should be understood to have the same meaning unless otherwise understood from the context.

As used herein, unless otherwise stated, the term "article" is used for simplicity to identify all types of apparel and accessory items, including but not limited to: baseball caps (e.g. caps formed from one or multiple panels of fabric), skirts, aprons, shorts, socks, sweatshirts, T-shirts, coats and jackets, sweaters, vests, trousers, overalls, bags (e.g., backpacks, cinch bags, messenger bags, tote bags, accessory bags, purses, handbags, beach bags, lunch bags, and luggage) and protective covers for books, tablets, and computers. While these are all examples of end articles, the term "article" is also used herein to describe the various portions which make up an end article. For example, the following are examples of articles which are a piece of a larger end article: one panel which forms a segment of a baseball cap; a pocket or receptacle which can be attached to a jacket; and a shoulder strap for a backpack. For simplicity, all of the aforementioned are examples of articles as the term is used in the specification.

Similarly, the term adornment refers to any decorative piece which can be included with or as a part of an article, such as a patch, a piece of fabric or material, a pin, a decorative feature or the like. The adornment may have an outer decorative surface that includes design, color, pattern, picture, logo, or the like. These examples are meant to be illustrative of how the terms article and adornment are used herein. Both terms, as used here, are meant to be construed broadly.

The use of the terms "include," "includes," "including," "have," "has," "having," "contain," "contains," or "containing," including grammatical equivalents thereof, should be understood generally as open-ended and non-limiting, for example, not excluding additional unrecited elements or steps, unless otherwise specifically stated or understood from the context.

Unless otherwise shown or described, the term "adjacent" generally means "next to" and not necessarily in direct contact with. However, all items described as adjacent can also be in direct contact in at least one embodiment.

The use of the singular herein, for example, "a," "an," and "the," includes the plural (and vice versa) unless specifically stated otherwise.

Where the use of the term "about" is before a quantitative value, the present teachings also include the specific quantitative value itself, unless specifically stated otherwise. As used herein, the term "about" refers to a ±10% variation from the nominal value unless otherwise indicated or inferred.

Where a percentage is provided with respect to an amount of a component or material in a structure or a composition, the percentage should be understood to be a percentage based on weight, unless otherwise stated or understood from the context.

It should be understood that the order of steps or order for performing certain actions is immaterial so long as the present teachings remain operable. Moreover, two or more steps or actions may be conducted simultaneously.

The use of any and all examples, or exemplary language herein, for example, "such as" or "including," is intended merely to illustrate better the present teachings and does not pose a limitation on the scope of the invention unless claimed. No language in the specification should be construed as indicating any non-claimed element as essential to the practice of the present teachings.

Terms and expressions indicating spatial orientation or altitude such as "upper," "lower," "top," "bottom," horizontal," "vertical," and the like, unless their contextual usage indicates otherwise, are to be understood herein as having no structural, functional or operational significance and as merely reflecting the arbitrarily chosen orientation of the various views of apparatus, devices, components, and/or features of the present teachings that may be illustrated in certain of the accompanying figures.

As used herein, the terms, "outer" and "exterior," generally refer to the surface of the component that would be viewed by a consumer and the terms, "inner" and "interior," generally refer to the surface of the component that would not been seen by a consumer during use and would face inward towards the body of the consumer or inward towards the inside of the accessory.

Although the term "cavity" is mainly used herein to describe the feature that exists between the outer and inner layers between the edge of the hole and the point(s) of attachment of the outer and inner layers outside or around the hole, other terms such as "opening," "slit," "void," and "space" also can be used.

The outer and inner layers of material in the article can be composed of various textiles, fabrics and cloth including woven and nonwoven textiles as well as synthetic textiles as appropriate for the article (e.g. apparel or accessory) for which a patch receptacle is created. The materials can be of various dimensions, shapes and colors.

In general, the aperture defined by the outer layer of material is a hole through that layer and is of a shape corresponding to an adornment, such as circular, elliptical, rectangular, square, or any other shape for which an article adornment is desired. Although the shape of the adornment typically will match the shape of the aperture in the article, particular embodiments can use adornments of different shape than the respective aperture.

With any of the articles of the subject disclosure, the cavity formed between the inner layer of material and the outer layer of material can exist between an edge of the aperture of the outer layer of material to the location(s) where the outer layer of material is secured or attached to the inner layer of material. In some embodiments, the outer layer of material is secured to the inner layer of material by stitches or stitching outside or around the perimeter of the hole at a distance from the edge of the hole to form the cavity.

The distance from the edge of the aperture to the location where the outer layer is secured or attached to the inner layer can vary but should be sufficient to conceal or hide the edges of an adornment placed into the aperture. In embodiments where no fastening mechanism is present on the inner layer, the distance typically will be greater than when a fastening mechanism is present to ensure that the entire outer edge of an adornment can be accommodated by or placed in the cavity to secure and hold it regardless of the orientation of the article itself. For example, the above-described distance (i.e., the width or depth of the cavity) can be about 0.1 inches, about 0.125 inches, about 0.15 inches, about 0.175 inches, about 0.2 inches, about 0.225 inches, about 0.25 inches, about 0.275 inches, about 0.3 inches, or larger.

FIG. 1A depicts an embodiment of an article 100 for attaching an adornment 116 (the adornment 116 being a patch in this case) in accordance with the subject technology. In particular, the article 100 includes an inner layer of material 104 (or just "inner layer 104") and an adjacent outer layer of material 102 (or just "outer layer 102"). The inner layer 104 has an interior surface 140 which is typically concealed from view (e.g., the inside of a baseball cap) and an exterior surface 142 which faces the opposite direction. An interior surface 146 of the outer layer 102 covers a portion of the exterior surface 142 of the inner layer 104 while an exterior surface 148 of the outer layer 102 is generally visible when the article 100 is being used and/or worn. An inner edge 110 of the outer layer 102 also forms an aperture 106, the aperture 106 serving as a hole though the outer layer 102 which exposes a portion 150 of the exterior surface 142 of the inner layer 104 when no adornment 116 is attached to the article 100.

In some embodiments, the exposed portion 150 includes a fastening mechanism, such as a hook and loop attachment or fastening mechanism or system (e.g., Velcro), a magnetic fastening mechanism or system, an adhesive fastening mechanism or system (e.g., on iron-on backing or a peel & stick backing), a snap fastening mechanism or system, a button fastening mechanism or system, a pin fastening mechanism or system, or the like. An interior surface 154 of the adornment 116 can then include a corresponding fastening mechanism (e.g. hooks to couple with loops of the fastening mechanism), to help removably secure the adornment 116 to the article 100 when the adornment 116 is placed within the aperture 106. In such a case, when no adornment 116 is within the aperture 106, the fastening mechanism will usually be visible through the aperture 106.

Figure 1B:
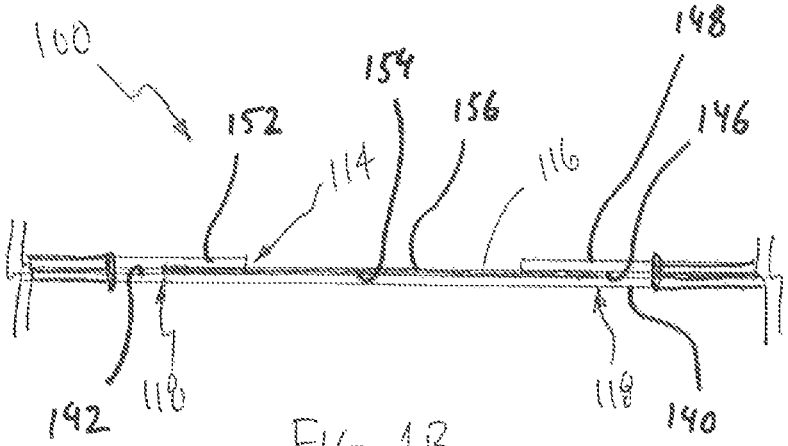

The outer layer of material 102 is secured to the inner layer of material 104 at by a coupling mechanism 112 at a distance 108 beyond the inner edge 110 which surrounds the aperture 106. Coupling mechanisms 112 might include, for example, stitching, adhesives, or any other means of securing two materials together (particularly two fabrics) as are known by those of skill in the art. The coupling mechanism 112 protrudes slightly form the outer layer 102 such that it is visible from the exterior. A loose inner lip 152 of the outer layer 102 sits above the exterior surface 142 of the inner layer 104 across the distance 108. Consequently, this design and construction creates a cavity 114 between the outer and inner layers 102, 104 between their point of attachment (at coupling mechanism 112) and the inner edge 110 around the aperture 106. The inner lip 152 can be flexible to allow for receipt of the adornment 116, such that the adornment 116 can be secured within the cavity 114 as shown in FIG. 1B and discussed more fully below. In some cases, the cavity 114 can effectively secure the adornment 116 even when no additional fastening mechanism is used.

Referring now to FIG. 1B, the adornment 116 shown above the aperture 106 in FIG. 1A is secured within the cavity 114 such that the outer edges 118 of the adornment 116 are secured under the inner lip 152. Since the portion 150 of the inner layer 102 within the aperture 106 contains no fastening mechanism, a portion of the outer edge 118 of adornment 116 is contained within the cavity 114 that is sufficient to ensure that the adornment 116 is held in place securely and cannot be easily removed unintentionally. The adornment 116 may include some kind of decorative feature on an exterior surface 156 such as a pattern, design, picture, drawing, logo, brand, or the like. In this way, the exterior surface 156 of the decorative feature is on display when the adornment 116 is attached to the article 100. In this way, the wearer can swap in various adornments 116 as they please to change the look of the article 100 without replacing the entire article 100.

Figure 2A:
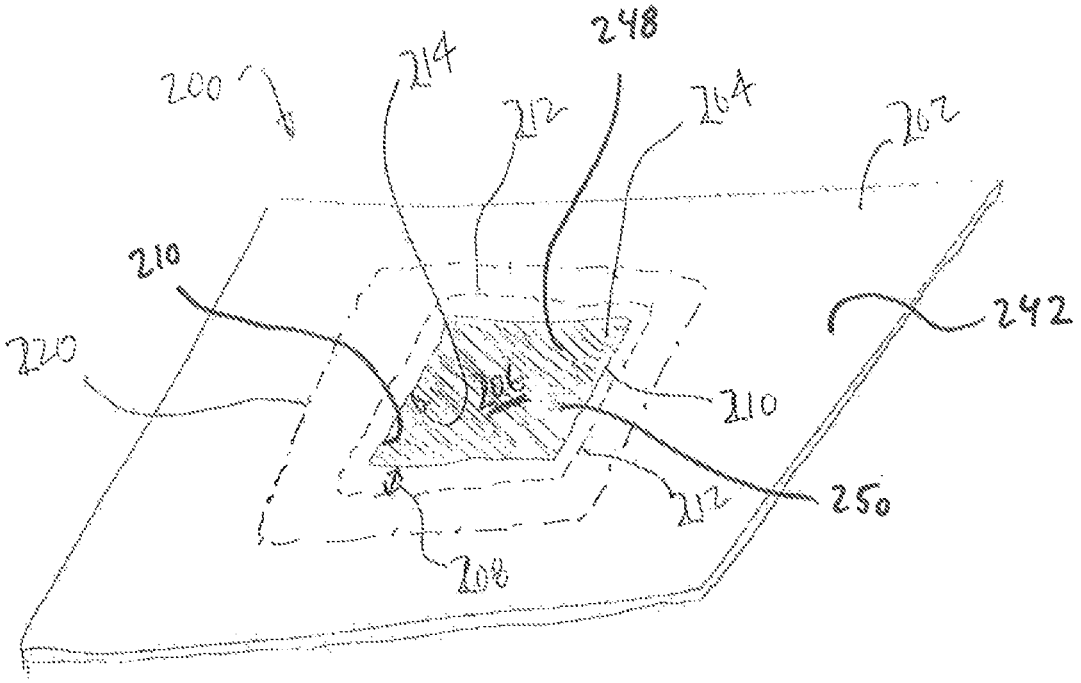

Referring now to FIG. 2A, a top perspective view of an article 200 which allows for removable attachment of an adornment 216 in accordance with the subject technology is shown. In FIG. 2A, the visible surfaces of the outer and inner layers 202, 204 respectively, represent the exterior surfaces 242, 248 of those respective layers as would be viewed when the article 200 is worn and/or used. Notably, as discussed above the article 200 could be part of a larger end article (e.g., integrated within a panel of a baseball cap) or could be a separate piece which could be coupled to an end article (e.g., a receptacle for receiving an adornment that could be sewn onto a pocket of a jacket).

The outer layer of material 202 of the article 200 is adjacent to the exterior surface 248 of an inner layer of material 204. An inner edge 210 of the outer layer 202 defines an aperture 206 which, when no adornment 216 is attached to the article 200, exposes a portion 250 of the exterior surface 248 of the inner layer 204. In some cases, the inner edge 210 can include stitching, rather than just a cut border which can be frayed. The exposed portion 250 includes a fastening mechanism (as discussed with respect to FIGS. 1A and 1B) for coupling with the interior surface of an adornment 216. The inner layer of material 204 has a surface area greater than the aperture 206. For example, the inner layer 204 can extend at least as far as an outer edge 220, depicted here as a dotted line. In other embodiments, the inner layer 204 can extend adjacent to the outer layer 202 for an even further distance.

Still referring to FIG. 2A, the inner layer of material 204 is attached or secured to the outer layer of material 202 outside or around the perimeter of the hole 206, and more specifically, outside or around the perimeter of the inner edge 210, using a coupling mechanism 212 or system, such as stitches. Although other techniques for attaching the outer layer to the inner layer 204 can be used, stitches are typically used for apparel and other textile-based accessories. As shown in FIG. 2A, a distance 208 (as shown by the double-headed-arrowed line) exists between the edge of the aperture 206 (defined here by inner edge 210) and the attachment of the inner layer of material 204 to the outer layer of material 202. This distance 208 corresponds roughly to the width or depth of the cavity 214 formed between the outer and inner layers of material 202, 204.

Figure 2B:
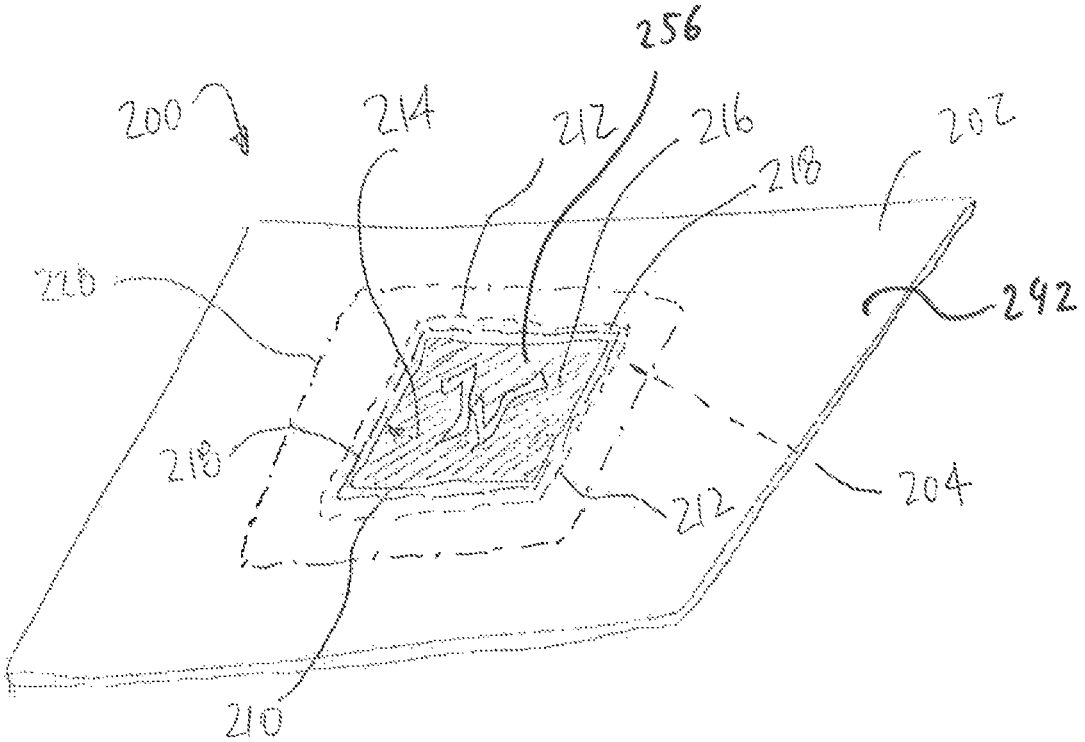

FIG. 2B shows a perspective view of the article 200 of FIG. 2A but with an adornment 216 attached, the adornment 216 taking the form of a patch with a "W" detail. The adornment 216 is retained by the cavity 214 and within the aperture 206. That is, outer edges 218 of the adornment 216 (the outer edges 218 being shown here in phantom) are inserted into the cavity 214 and secured between the outer and inner layers 202, 204. As seen in FIG. 2B, the entire patch edge 218 is concealed by the cavity 214 under the hole edge 210. The adornment 216 and cavity 214 are sized appropriately such that the outer edge 218 of the adornment 216 does not extend beyond the point of attachment of the outer layer 202 to the inner layer 204. This allows the adornment 216 to lie flat along the exterior surface 248 of the inner layer of material 204 such that the adornment 216 will not buckle or protrude outward or away from the article 200 as a result of lack of space or surface area to accommodate the adornment 216 surface area.

Further, the adornment 216 can include a fastening mechanism on an interior surface (not distinctly shown) for coupling with a fastening mechanism with the exposed portion 250 of the inner layer 204. For example, the adornment 216 may include a series of hooks as a fastening mechanism while the portion 250 of the inner layer 204 may include a series of loops as a fastening mechanism, wherein the two fastening mechanisms operable to couple together and further secure the adornment 216 within the cavity 214 and aperture 206 (notably, the fastening mechanisms could be any of the examples as provided with respect to FIGS. 1A and 1B). In general, the fastening mechanism on the inner layer 204 will coincide with the portion 250 that is exposed via the aperture 206 such that it also coincides with any fastening mechanism on the underside of the adornment 216 when the adornment 216 is attached. Similarly, the aperture 216 and exposed portion 250 will tend to have a shape that corresponds with the shape of the adornment 216, such as square, rectangular, triangular, circular, semi-circular, ellipsoidal, or the like.

Figure 3A:
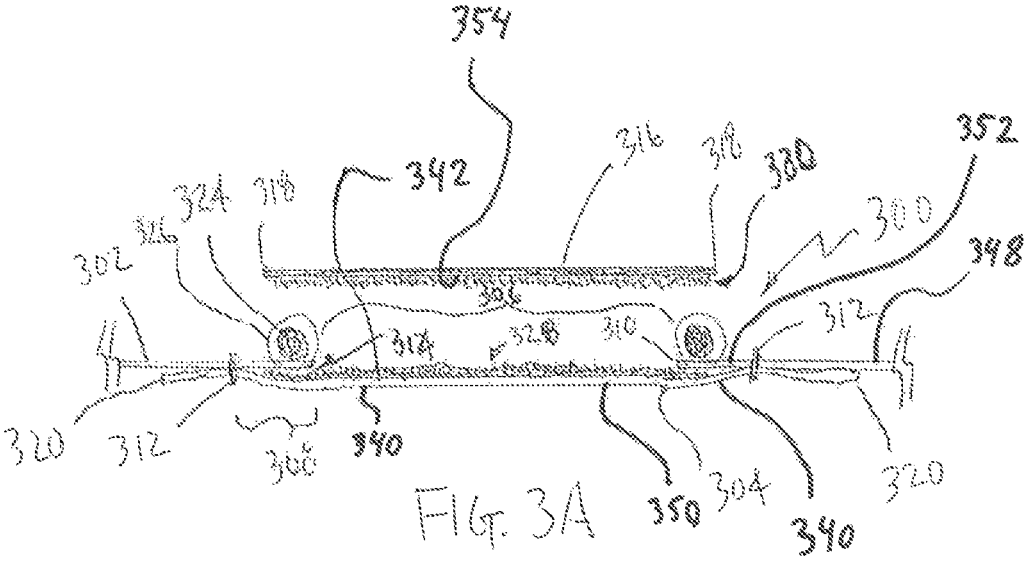

Referring now to FIG. 3A, a cross-sectional view of an embodiment of an article 300 and removable adornment 316 are shown. The article 300 includes a first fastening mechanism 328 in the form of a series of hooks which can couple with a second fastening mechanism 330 of the adornment 316. In general, the first fastening mechanism 328 is situated on the inner layer 304 of the article 300, such that it coincides with the aperture 306 and the cavity 314.

As shown in FIG. 3A, the article 300 also includes a material-raising structure 324 adjacent to the aperture 306. The material-raising structure 324 can either be a part of the outer layer 302 or can be coupled thereto. For example, the material-raising structure 324 can be coupled to the exterior surface 348 of the outer layer 302 at a location on the inner lip 352, such as proximate to the inner edge 310, or formed as an integral part thereto. In the case where the material-raising structure 324 is coupled to the outer layer 304, coupling can be done by a securing mechanism or system 326 such as with stitches (e.g. satin stitching) as shown. The material-raising structure 324 can protrude outwardly from the outer layer 304 (i.e. away from the exterior surface) and extend at least partially over the aperture 306 to further secure the adornment 316 when it is attached to the article 300 and/or to partially cover up the adornment 316 for aesthetic considerations. The material-raising structure 324 can be made of a variety of materials provided it has sufficient strength and flexibility to have a securing mechanism or system 326 secure or attach it to the outer layer 304 without collapsing or deforming but also which is able to outline the inner edge around the aperture 306 in its various configurations, such as circular, elliptical, square, rectangular and other shapes. Examples of a material-raising 324 structure include strings, cords, twine, and rope made of a polymeric material or a non-polymeric textile or combinations thereof. One example of a material-raising structure 324 is an O-ring, which can be suitable for around a circular aperture 306. Another example of a material-raising structure 324 is a thin length of a polymer such as ethylene vinyl acetate.

Further, a raised, stitched border around the outer layer of material 302 is shown. More specifically, the article 300 includes an outer layer of material 302 and an inner layer of material 304, where the outer edge 320 of the inner layer 304 of material can be seen from the back, or interior side of the layers 302, 304. As with the articles described above, the aperture 306 through the outer layer 302 exposes a portion 350 of the inner layer 304, such that the exterior surface 342 of the inner layer 304 is visible through the aperture 306. The outer layer of material 302 is secured to the inner layer of material 304 at a distance 308 beyond the edge of the aperture 306 (i.e. the inner edge 310 of the outer layer 302) for example, with a coupling mechanism 312 such as stitches. Consequently, this design and construction creates a cavity 314 between the outer and inner layers of material 302, 304 (which is shown in an exaggerated fashion as the inner layer 304 usually would not be "buckled" underneath the outer layer 302 as shown but would be in a more linear and parallel fashion coinciding with the topography of the outer layer 302).

Although the inner layer of material 304 can be coextensive with the outer layer of material 302, the inner layer of material 304 should be able at least to cover the aperture 306 and have enough additional material or surface area to extend beyond the attachment point of the inner layer 304 to the outer layer 302 (shown here as attached at the coupling mechanism 312). For example, the coupling mechanism 312 might be stitching surrounding and at a fixed or changing distance from the aperture 306 such that a cavity 314 is created between the outer and inner layers of material 302, 304. Where the inner layer 304 of material is not coextensive with the outer layer 302 and portions of the inner layer of material 304 are unattached and loose, another layer of material, for example a back lining 332 (see FIG. 3B), can be placed and/or secured on the interior of the inner layer of material 304, i.e., behind the interior surface 340 of the inner layer of material 304 that is opposite of the exterior surface 342 of the inner layer 304 as seen through the aperture 306. Use of a back lining 332 can avoid discomfort to the wearer, present a more sophisticated and seamless look, and/or secure further the inner layer 304 to the outer layer 302 and/or to the article 300.

Figure 3B:
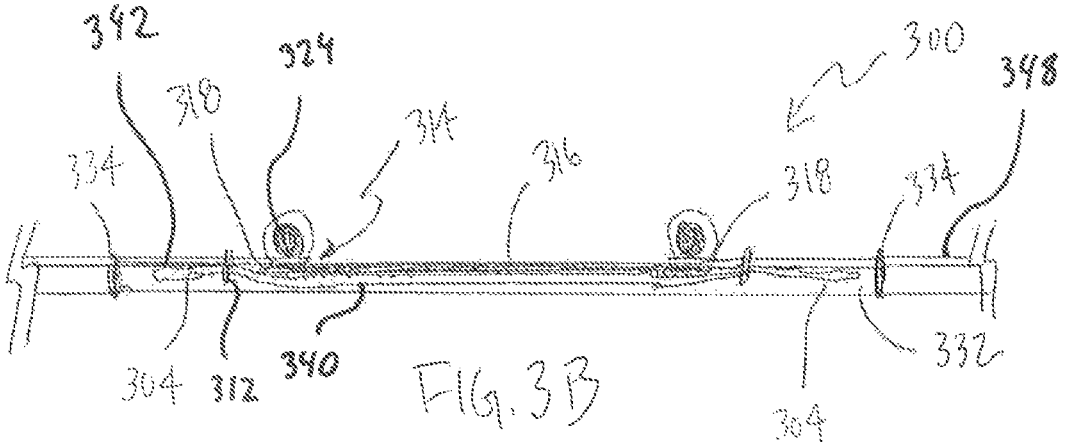

To that end, as shown in FIG. 3B, the article 300 contains the adornment 316. More specifically, the adornment 316 is placed in the aperture 306 of the article 300 such that the fastening mechanism 328 on the exterior surface 342 of the inner layer of material 304 is secured to the fastening mechanism 328 on the inner or interior surface 354 of the adornment 316 (see FIG. 3A). Moreover, the outer edges 318 of the adornment 316 are concealed from view in that they are within the cavity 314. Although not shown in FIG. 3A, the article 300 in FIG. 3B may also include a back lining 332 covering the inner surface 340 of the inner layer of material 304 proximate to the area of the fastening mechanism 328 or exposed portion 350 (although on the opposite surface of the inner layer 304). The back lining 332 is secured to the outer layer of material 302 at an attachment location 334 surrounding the coupling mechanism 312.

In various embodiments where a back lining 332 is used adjacent to the inner layer of material 304 opposite the outer layer of material 302, the inner layer of material 304 and in particular, the area 350 that coincides with the aperture 350, can be secured to the back lining 332 to further strengthen the attachment of the inner layer of material 304 to the article 300. Such additional attachment can be beneficial when a fastening mechanism or system (e.g. fastening mechanism 328) is present on the inner layer of material 304, which will be pushed, pulled, and otherwise manipulated in placing and removing adornments 316 from the article 300. In particular, the back lining 332 can cover the interior surface 340 of the inner layer 304 at least at a location proximate to the fastening mechanism 328 to shield the interior of the article 300.

Figure 4A:
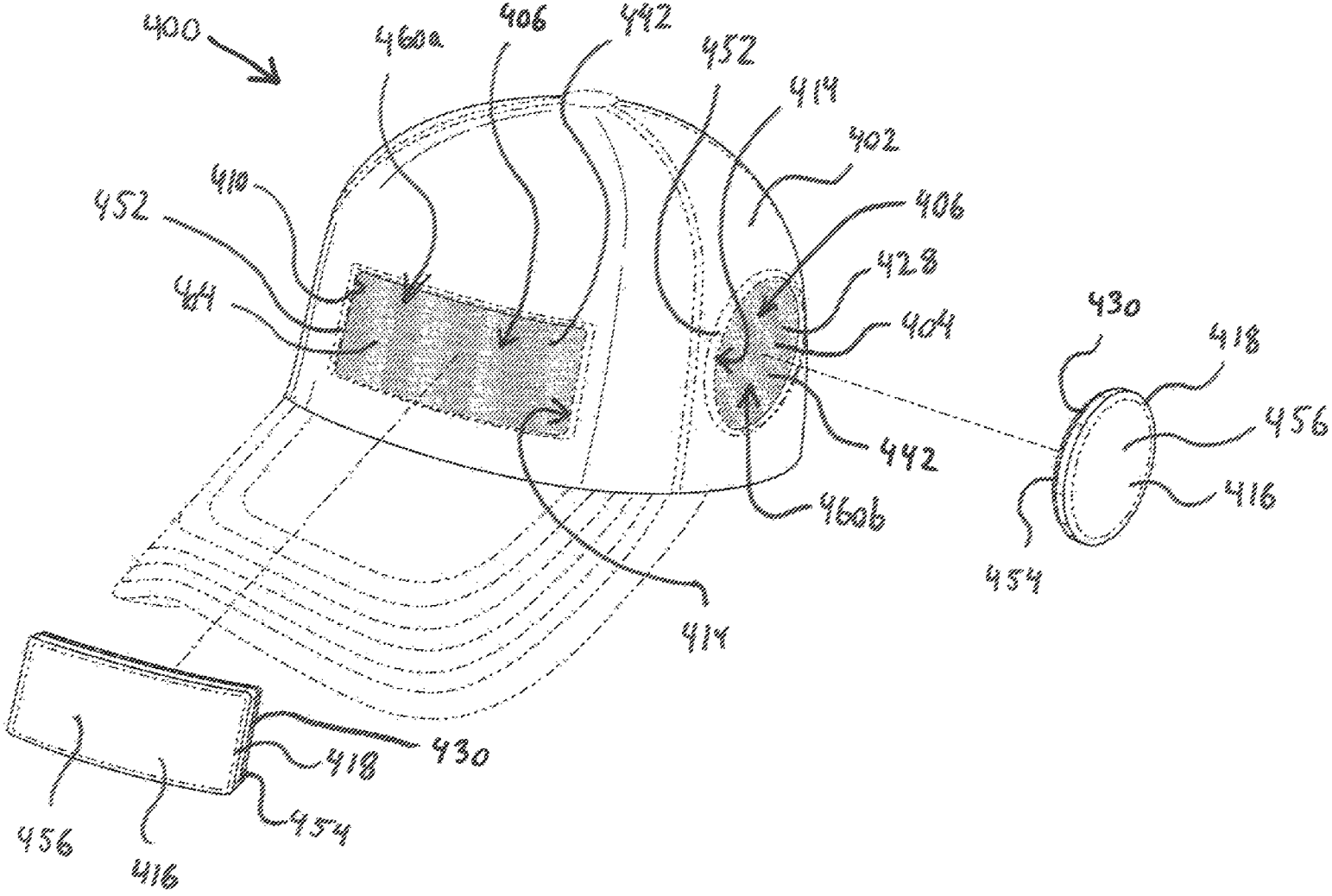
Figure 4B:
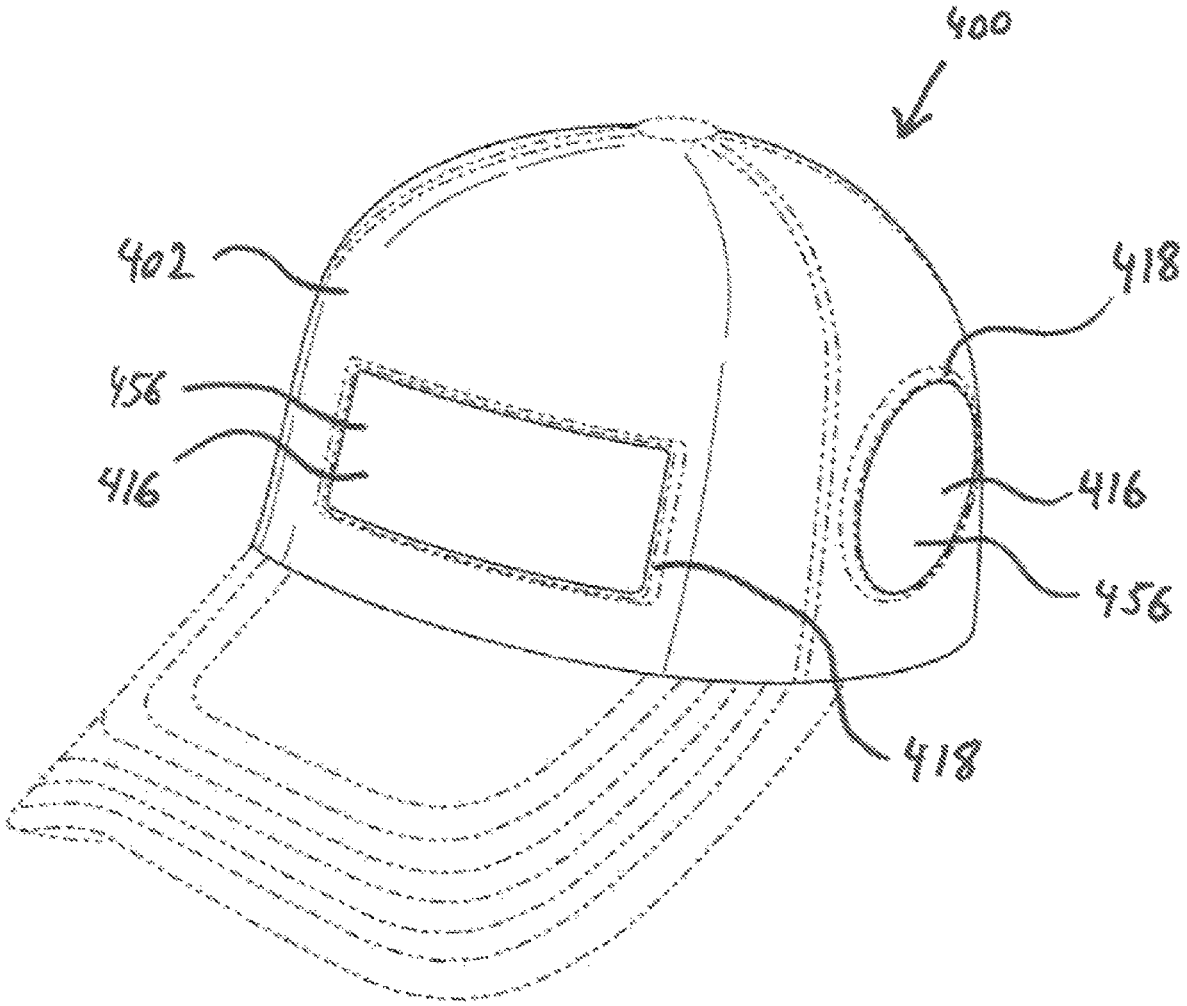

Referring now to FIGS. 4A-4B, an article 400, in this case a baseball cap, which allows for removable attachment of two adornments 416, is shown. In particular, FIG. 4A shows the article 400 with the two adornments 416 unattached, while FIG. 4B shows the same article 400 with both adornments 416 attached. The article 400 can be formed from multiple panels of fabric, with one or more of the panels including one or more adornments 416. Alternatively, the article 400 can be formed from a single piece of fabric with one or more adornments 416.

Referring to FIG. 4A, the article 400 includes two areas 460*a*, 460*b* where adornments 416 can be removably attached. As shown, the areas 460*a*, 460*b* are rectangular and circular, respectively, and the corresponding adornments 416 are of a like shape. At both locations 460*a*, 460*b*, apertures 406 through the outer layer of material 402 expose the exterior surface 442 of the inner layer of material 404 when the adornments 416 are unattached. The inner layer 404 includes a fastening mechanism 428 (in this case hooks) which can couple with fastening mechanisms 430 on the interior surface 454 of the adornments 416 (e.g. loops). The adornments 416 have outer edges 418 which are hidden from view once attached to the article 400, as discussed more fully below.

Referring now to FIGS. 4A-4B, the separated adornments of FIG. 4A have been passed through the apertures 406 and attached to the inner layer 404 in FIG. 4B. As shown, in the position of FIG. 4B, the outer edge 418 of the adornments sits in the cavity 414 formed between the inner lip 452 of the outer layer 402 and the inner layer 404. The fastening mechanisms 428, 430 of the inner layer 404 and the adornment 416 have attached to further secure the adornments 416 to the articles 400. Typically, the exposed exterior surfaces 456 of the adornments 416 will have a design, color, pattern, picture, logo, or the like, to display to the user.

Figure 5:
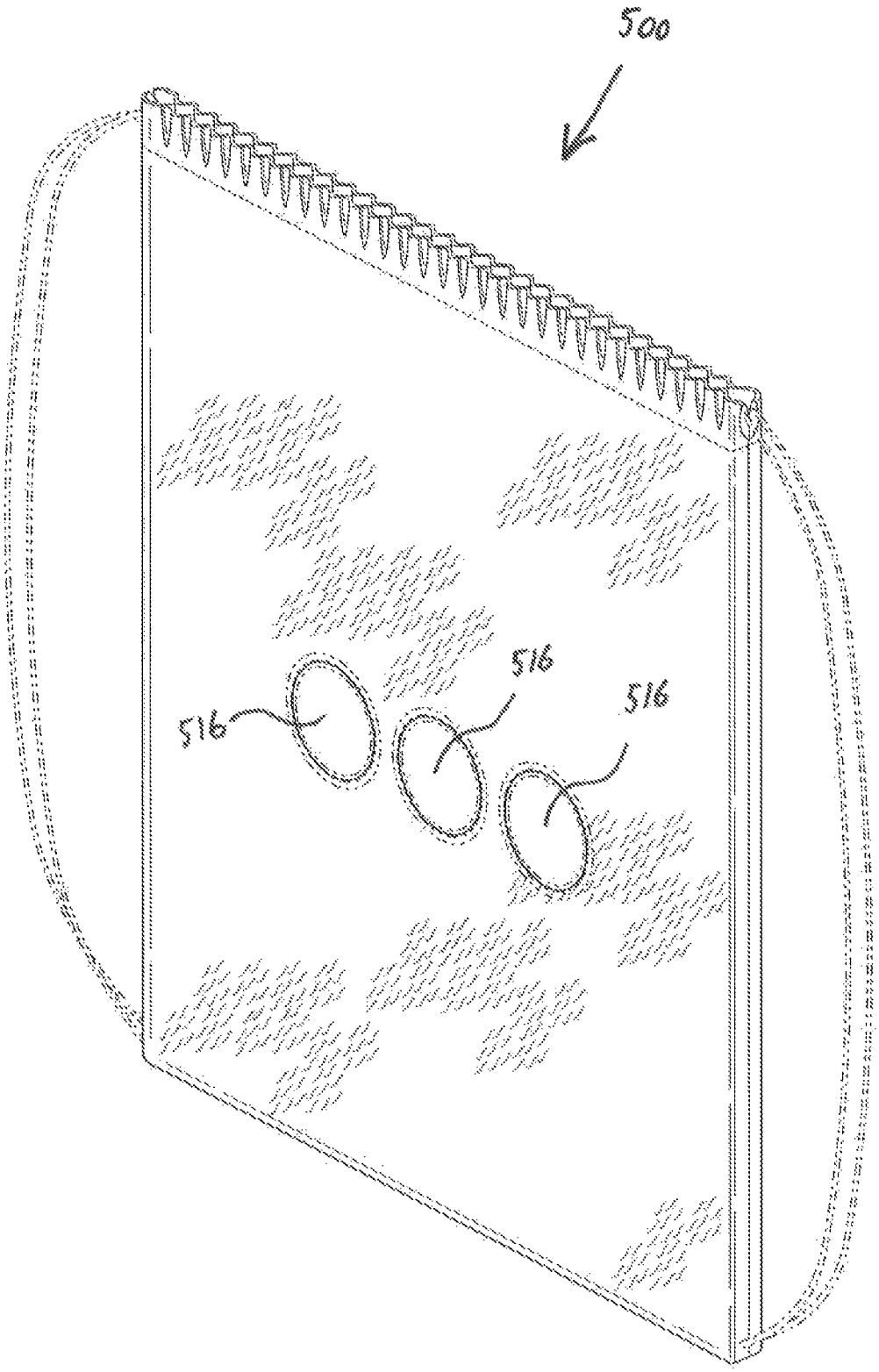
FIG. 5 is a perspective view of a bag configured for removable attachment of an adornment in accordance with the subject disclosure.

Referring now to FIG. 5, another embodiment of an article 500 with attached adornments 516 is shown. The article 500 functions similarly to the article 400 described with respect to FIGS. 4A-4B (as well as the other embodiments described herein) in terms of allowing for removable attachment of adornments 516, except that the underlying article is a bag rather than a baseball cap. To that end, while the adornments 516 are relatively secure within the article 500, they can be removed at will by the user. In this case, the adornments 516 attach to the article 500 at three locations, aligned along the center of the article 50. However, the attachment locations can be formed at any location along an exterior of the article 500.

Notably, in various embodiments, the article for removably attaching an adornment can be created by separately forming an attachment portion, such as a patch receptacle, pocket portion, or sleeve. The patch receptacle, pocket portion, or sleeve can then be added to the end article, such as by sewing it into the fabric of the article. In this way, the article of the subject technology can be formed when the receptacle, pocket, or sleeve are coupled together with the article.

The present teachings also provide methods of making the articles and patch receptacles as described herein. A method of making a patch receptacle of the present teachings generally includes cutting a hole in an outer layer of material; and attaching an inner layer of material to the outer layer of material outside or around the perimeter of the hole at a distance greater than or beyond the edge of the hole from the interior of the hole thereby creating a cavity between the outer layer of material and the inner layer of material. In the case where the entire article of the subject technology is formed as a single article (rather than separately), an inner layer and outer layer of material of the article can be formed with the features described herein. The adornment, or multiple adornments, can then be formed separately and attached to the article when desired.

The methods of making a patch receptacle, or the article as described above (or a portion thereof), can include stitching the edges of the aperture as with satin stitching or by creating a merrow border. The methods can include creating a raised stitched border, for example, by securing a material-raising structure around the hole on the outer or exterior face or surface of the outer layer of material and adjacent to, near or at the edge of the hole. In various embodiments, the material-raising structure can be satin stitched to the outer layer of material. It should be understood that the stitching around the hole of the upper layer of material including stitching a raised border around the hole does not involve stitching the inner layer of material.

The methods of making a patch receptacle, or the article as described above (or a portion thereof), can include sewing a back lining to the inner or interior surface or face of the outer layer of material over the inner layer of material so as to conceal the inner surface or face of the inner layer of material. Such methods also can include securing the inner layer of material to the back lining, for example, by sewing or stitching.

It should be understood that the general methods described above can be implemented for a variety of materials and different designs as described herein. For example, the inner layer of material can include a fastening mechanism that can coincide with the aperture and/or cavity.

The present teachings also include methods of using articles for removable attachment of adornments and/or patches as described herein. That is, a method of using the present teachings can generally include placing the inner or interior surface of a patch in contact with the outer or exterior surface of the inner layer of material coinciding with the aperture. In various embodiments, for example, where no fastening mechanism is present, the size of the patch should be larger than the visible aperture such that the outer edges of the patch can be concealed and maintained in the cavity created between the outer and inner layers of material. Even when a fastening mechanism is present, the size of the patch can be larger than the visible area through the aperture to conceal its outer edges and thereby present a bordered patch despite the removable patch being borderless. That said, when a fastening mechanism is present, it should be understood that the patch can be the same size as or smaller than the aperture. In these cases, despite not taking advantage of the cavity, a patch, which can be a bordered patch, can be removably secured to the article and forms part of the present teachings.

The following example is provided to illustrate further and to facilitate the understanding of the present teachings and is not in any way intended to limit the invention.

Example 1

A 5.2 cm (2.05") diameter aperture was laser cut into a panel of a baseball cap (outer layer of material). A 2.2 mm thick cord of ethylene vinyl acetate ("EVA") was used as a material-raising structure and was placed on the exterior face or surface of the panel to create a raised border around the circular aperture. The EVA border was satin stitched (i.e., satin stitching was over and around the EVA border) to the panel using the stitches of the same fabric color as the baseball cap panel to secure the EVA border to the cap panel around the circular hole.

Velcro material (inner layer of material) having a loop attachment and that is similar in color to the color of the fabric was cut into a 7 cm (2.75") diameter piece. The circular piece of Velcro material was placed against the inner or interior surface of the cap panel and centered on the hole so that the circular piece of Velcro material roughly covered the hole and had about an equal amount of material about the edge of the hole. The Velcro material was sewn or stitched to the cap panel outside and around the satin stitched EVA border at a distance just greater than the width of the satin stitched EVA border, i.e., circular stitching having a diameter of about 2.3" (diameter of hole=2.05" and EVA border with stitching about ⅛" so that 2.05"+0.125"+0.125"=2.3"). The thread stitching the Velcro material to the cap panel matched the color of the baseball cap panel.

Finally, a back lining of material similar to the cap panel was sewn to the inside of the panel to cover the panel and the Velcro material including its outer edges so that the circular Velcro material cannot be seen from the inside of the baseball cap. In addition, the Velcro material was secured with stitches to the back lining at various places to coincide with the hole to assist keeping the Velcro material in place and especially when in use.

The present teachings encompass embodiments in other specific forms without departing from the spirit or essential characteristics thereof. The foregoing embodiments are therefore to be considered in all respects illustrative rather than limiting on the present teachings described herein. Scope of the present invention is thus indicated by the appended claims rather than by the foregoing description, and all changes that come within the meaning and range of equivalency of the claims are intended to be embraced therein.

What is claimed is:

1. An article allowing for removable attachment of an adornment, the article comprising:

an inner layer;

an outer layer adjacent to an exterior surface of the inner layer, an inner edge of the outer layer defining an aperture surrounding a first portion of the exterior surface of the inner layer;

a coupling mechanism attaching the outer layer to the inner layer at an attachment location surrounding the entire inner edge of the outer layer such that an inner lip of the outer layer is formed between the attachment location and the inner edge; and a cavity surrounding the entire aperture, formed between the inner layer, the inner lip of the outer layer, the coupling mechanism, and the aperture to receive outer edges of the adornment to removably attach the adornment to the article, wherein when the adornment is attached to the article, an exterior surface of the adornment is exposed via the aperture.

2. The article of claim 1 further comprising a fastening mechanism coupled to the first portion of the exterior surface of the inner layer for further removably securing the adornment when the adornment is attached to the article.

3. The article of claim 2 wherein the fastening mechanism comprises a plurality of hooks and the adornment has a plurality of loops on an interior surface, wherein the loops are configured to couple to the hooks for removably attaching the adornment to the fastening mechanism.

4. The article of claim 2 wherein the fastening mechanism comprises a plurality of loops and the adornment has a plurality of hooks on an interior surface, wherein the loops are configured to couple to the hooks for removably attaching the adornment to the fastening mechanism.

5. The article of claim 1 further comprising a back lining disposed adjacent to an interior surface of the inner layer proximate to the first portion.

6. The article of claim 5 wherein the back lining is coupled to the outer layer at a location surrounding the attachment location.

7. The article of claim 1 further comprises a material-raising structure is secured to an exterior surface of the inner lip.

8. The article of claim 7 wherein the material-raising structure extends outwardly from an exterior surface of the inner lip and at least partially over the aperture to further secure the adornment when the adornment is attached to the article.

9. The article of claim 8 further comprising a fastening mechanism coupled to the first portion of the exterior surface of the inner layer for further removably securing the adornment when the adornment is attached to the article, wherein:

the fastening mechanism and the adornment are configured for removable attachment via hooks and loops;

the aperture is circular;

the adornment is a circular patch;

the attachment location forms a circular perimeter at a distance from the aperture; and the cavity is located between the attachment location and the aperture.

10. The article of claim 9 further comprising a back lining coupled to the outer layer at a location surrounding the attachment location, wherein the back lining covers an interior surface of the inner layer.

11. The article of claim 1 wherein the article is configured to be worn as a baseball cap.

12. The article of claim 1 wherein the article is configured to be carried and hold items as a bag.

* * * * *